US010431411B2

(12) United States Patent
Fernández et al.

(10) Patent No.: US 10,431,411 B2
(45) Date of Patent: Oct. 1, 2019

(54) FUSE WITH A THERMOMECHANICAL COMPENSATION ELEMENT

(71) Applicants: PACIFIC ENGINEERING CORPORATION, Ogaki, Gifu (JP); DAIMLER AG, Stuttgart (DE)

(72) Inventors: Pedro Fernández, Gifu (JP); Jürgen Freytag, Egelsbach (DE); Sascha Schulte, Leinfelden (DE); Akihiko Shimizu, Gifu (JP); Hartung Wilstermann, Aichtal (DE)

(73) Assignee: PACIFIC ENGINEERING CORPORATION (JP)

( * ) Notice: Subject to any disclaimer, the term of this patent is extended or adjusted under 35 U.S.C. 154(b) by 0 days.

(21) Appl. No.: 14/441,325

(22) PCT Filed: Nov. 14, 2013

(86) PCT No.: PCT/EP2013/073827

§ 371 (c)(1),
(2) Date: May 7, 2015

(87) PCT Pub. No.: WO2014/076180

PCT Pub. Date: May 22, 2014

(65) Prior Publication Data

US 2015/0294829 A1 Oct. 15, 2015

(30) Foreign Application Priority Data

Nov. 17, 2012 (DE) ..... 10 2012 022 562

(51) Int. Cl.
*H01H 85/38* (2006.01)
*H01H 85/055* (2006.01)
(Continued)

(52) U.S. Cl.
CPC ..... *H01H 85/38* (2013.01); *H01H 85/0013* (2013.01); *H01H 85/042* (2013.01);
(Continued)

(58) Field of Classification Search
CPC .. H01H 85/0013; H01H 85/042; H01H 85/08; H01H 85/18; H01H 85/175;
(Continued)

(56) References Cited

U.S. PATENT DOCUMENTS 2,109,850 A * 3/1938 Saudicoeur ..... H01H 85/055 337/246
2,300,142 A * 10/1942 Wood ..... H01H 85/36 337/164
(Continued)

FOREIGN PATENT DOCUMENTS

DE 907077 C 3/1954
DE 102010055918 A1 8/2011

*Primary Examiner* — Anatoly Vortman
(74) *Attorney, Agent, or Firm* — Tarolli, Sundheim, Covell & Tummino LLP

(57) ABSTRACT

The invention relates to a melting fuse, especially for a motor vehicle that has a high-voltage circuit, comprising an electrically insulating housing inside of which there is a fusible conductor that connects two contacts with each other, whereby, between two longitudinal areas that are adjacent to each other, the fusible conductor has a rotation point around which the longitudinal areas can be rotated in case of a thermo-mechanical expansion.

9 Claims, 1 Drawing Sheet

(51) Int. Cl.

| | |
|---|---|
| ***H01H 85/175*** | (2006.01) |
| ***H01H 85/00*** | (2006.01) |
| ***H01H 85/042*** | (2006.01) |
| ***H01H 85/08*** | (2006.01) |
| ***H01H 85/18*** | (2006.01) |
| *H01H 85/10* | (2006.01) |

(52) U.S. Cl.
CPC ..... *H01H 85/055* (2013.01); *H01H 85/08* (2013.01); *H01H 85/175* (2013.01); *H01H 85/18* (2013.01); *H01H 85/10* (2013.01); *H01H 2085/388* (2013.01); *H01H 2231/026* (2013.01); *H01H 2239/044* (2013.01)

(58) Field of Classification Search
CPC ..... H01H 85/38; H01H 85/055; H01H 85/10; H01H 2239/044; H01H 2085/388; H01H 2231/026
USPC ..... 337/159, 165, 227
See application file for complete search history.

(56) References Cited

U.S. PATENT DOCUMENTS 2,337,937 A * 12/1943 Serfling ..... H01H 85/042 337/231
2,343,224 A * 2/1944 Powell ..... H01H 85/303 337/244
3,479,630 A 11/1969 Kozacka
3,611,238 A * 10/1971 Kozacka ..... H01H 85/055 337/159
3,636,491 A * 1/1972 Cameron ..... H01H 85/303 337/161
3,858,142 A * 12/1974 Deelman ..... H01H 69/02 29/623
4,020,441 A 4/1977 Jacobs, Jr.
4,114,128 A * 9/1978 Cameron ..... H01H 85/303 337/162
4,219,793 A 8/1980 Kawamura
4,417,224 A * 11/1983 Ross ..... H01H 85/055 337/164
4,563,809 A * 1/1986 Reeder ..... H01H 69/02 29/623
4,635,023 A 1/1987 Oh
5,929,739 A * 7/1999 Totsuka ..... H01H 85/0417 337/190
6,507,265 B1 * 1/2003 Ackermann ..... H01H 85/055 337/260
D550,631 S * 9/2007 Murakami ..... D13/161
7,498,923 B2 * 3/2009 Iversen ..... H01H 39/006 200/61.08
2007/0159291 A1 * 7/2007 Wilniewczyc ..... H01H 85/042 337/159

* cited by examiner

FUSE WITH A THERMOMECHANICAL COMPENSATION ELEMENT

The invention relates to a melting fuse, especially for a motor vehicle that has a high-voltage circuit, according to the features described herein.

RELATED APPLICATIONS

This present invention is a U.S. National Stage under 35 USC 371 patent application, claiming priority to Serial No. PCT/EP2013/073827, filed on 14 Nov. 2013; which claims priority from German Application No. 10 2012 022 562.8, filed 17 Nov. 2012, the entirety of both of which are incorporated herein by reference.

BACKGROUND

Melting fuses have been known for a long time. They constitute an overcurrent protective device that interrupts the electric circuit by melting a fusible conductor. The fusible conductor is heated by the current that passes through it, and it melts if the current passing through it is markedly exceeded during a certain time span.

Melting fuses heat up under a strong electric load. The resultant thermo-mechanical expansions can ultimately lead to fatigue failure of the fusible conductor.

When it comes to protecting high-voltage electric circuits in motor vehicles having an electric or hybrid drive, very high requirements are made of melting fuses that are installed in high-voltage electric circuits. An uncontrolled short circuit can destroy the entire electrical system. Moreover, there is a high risk of injury to persons located in the immediate vicinity of the high-voltage electric circuit.

For purposes of ensuring reliable functioning of the melting fuse, it is necessary to ensure that the physical and chemical properties of the melting fuse remain unchanged even after being repeatedly stressed. Consequently, it must be prevented that a fuse loses its properties due to thermo-mechanical expansions of the fusible conductor since otherwise, faulty triggering or premature failure of the fusible conductor can occur due to material fatigue.

Many development avenues are being pursued with an eye towards preventing fatigue failure of the fusible conductors in melting fuses. For this purpose, fusible conductors are affixed, for example, in solidified quartz sand or cement, a measure intended to limit their movement in case of thermal-mechanical expansion. In this context, the fusible conductor is clamped in such a way that stresses can be optimally transferred into the fixation material. For one thing, the fusible conductors are designed so as to be angled, an approach that entails the drawback of mechanical peak stresses in the individual angles of the fusible conductor, which can ultimately lead to premature fatigue failure. Other fusible conductors are affixed in the cement in a wavy or spiral shape. As a result, the spiral wire, which serves as the fusible conductor, is free of potential kinked places but it then has the same diameter over its entire length, something which, in turn, makes a fast and reliable triggering more difficult since a so-called pseudo-fuse is not present. Another disadvantage of fusible conductors affixed in cement or solidified quartz sand is the high requirements made of the production process of such a melting fuse which, in turn, translates into higher production costs.

This objective is achieved by means of a melting fuse having the features described herein.

BRIEF DESCRIPTION OF THE DRAWINGS

The present invention and its embodiments will be explained in greater detail below on the basis of drawings. The following is shown.

DETAILED DESCRIPTION

Figure 1:
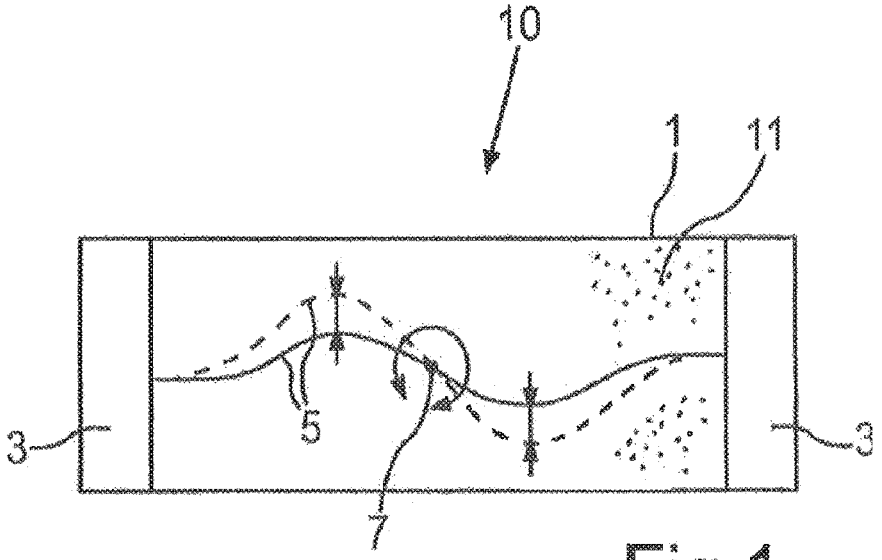
FIG. 1: a side view of a melting fuse according to an embodiment of the invention.

It is an objective of the present invention to put forward a melting fuse—especially for a motor vehicle that has a high-voltage electric circuit—whose service life is considerably prolonged and whose production costs can be kept low.

This objective is achieved by means of a melting fuse having the features described herein.

Such a melting fuse has an electrically insulating housing inside of which there is a fusible conductor that connects two contacts with each other, whereby, between two longitudinal areas that are adjacent to each other, the fusible conductor has a rotation point around which the longitudinal areas can rotate in case of a thermo-mechanical expansion. In this context, it is particularly advantageous for the fusible conductor to respond like one or more spring elements that are bent uniformly and are free of kinks, thus allowing expansions of the fusible conductor caused by the thermo-mechanical stresses to be converted into a rotational movement. This prevents a kinking movement during which mechanical load peaks would have to be absorbed, thereby minimizing the risk of premature fatigue failure of the fusible conductor.

In a particularly preferred embodiment of the invention, the fusible conductor has a centrosymmetrical shape. Such a configuration of the fusible conductor makes it possible to easily take into account the individual movement ranges or rotation ranges of the expanding fusible conductor on the basis of the dimensioning. Moreover, the centrosymmetrical shape allows a uniform distribution of the thermo-mechanical stresses inside the fusible conductor. In particular, it is advantageous for the fusible conductor to have a reduced cross section at the rotation point—here the centrosymmetrical point—in other words, a resting place, since only minimal mechanical loads occur in the reduced cross section of the pseudo-fuse in such a case In a preferred embodiment, the arc suppressing means is quartz sand. In the case of a short circuit, the current passing through the fusible conductor can reach levels that are higher than the rated current of the fuse by several orders of magnitude. In this process, during a short circuit, the fusible conductor traverses three states of aggregation, namely, solid, liquid and gaseous. When the fusible conductor is in the gaseous state, a plasma is created through which current flows; an arc is formed that strongly heats the quartz sand. In this process, the melting quartz sand cools the arc so intensely that re-ignition—of the plasma—is effectively prevented. In this process, the arc is extinguished and the line that is to be protected is thus disconnected from the source of fed-in current or voltage.

In an especially preferred embodiment of the invention, the fusible conductor is movable in the arc suppressing means—quartz sand—that surrounds it. In contrast to conventional melting fuses, in which the fusible conductor in firmly affixed in solidified cement or quartz sand, the fusible conductor according to an embodiment of the invention is arranged so that it is movable inside the housing and in the quartz sand or arc suppressing means contained therein. This freedom of movement allows the fusible conductor to convert the expansions caused by a thermo-mechanical expansion into a resilient rotational movement. As a result, the service life of the fusible conductor of the melting fuse according to the invention is considerably prolonged and its physical-chemical properties can be ensured over a longer period of time. The simple requirements made of the production process of such melting fuses translate into additional cost savings.

It is especially practical for the fusible conductor to be surrounded by an arc suppressing means in the insulating housing. Since an arc whose intensity depends, among other things, on the magnitude of the current that is to be connected can occur when the electric circuit is switched off, it must be possible to cool the circuit very effectively.

FIG. 1 shows an embodiment of the melting fuse 10 according to the invention, comprising an electrically insulating housing 1 inside of which there is a fusible conductor 5 that connects two contacts 3 with each other. The housing 1 additionally contains an arc suppressing means 11—indicated here as a dotted surface—that loosely surrounds the fusible conductor, that is to say, the fusible conductor 5 is movably embedded in the arc suppressing means 11.

In case of a strong electric load, the fusible conductor 5 of the melting fuse 10 heats up. Thermo-mechanical stresses in the fusible conductor cause it to be deformed, which generally can be the cause of premature fatigue failure. In the embodiment shown in FIG. 1, the fusible conductor 5 is shaped in such a way that it has a rotation point 7 around which the longitudinal areas can be rotated in case of a thermo-mechanical expansion.

In FIG. 1, the fusible conductor 5 in the cooled state is depicted by a solid line, whereas a broken line depicts the state of the fusible conductor 5 while under a strong electric load, that is to say, heated up. By means of a suitable selection of the shape of the fusible conductor 5, expansions brought about by thermo-mechanical stresses can be converted into a rotational movement. Accordingly, the fusible conductor 5 "cushions" the occurring thermal stresses.

In the present embodiment, the fusible conductor 5 has a centrosymmetrical shape, whereby the rotation point 7 is the point of intersection of an axis of symmetry with the fusible conductor.

Since the fusible conductor 5 is movably mounted in the arc suppressing means in the housing 1 of the melting fuse 10 according to the invention, no appreciable forces counteract the movement of the fusible conductor 5. Accordingly, the fusible conductor 5 can be deformed unimpeded in the housing 1. A preferred arc suppressing means 11 in this case is quartz sand. If a short circuit occurs, the quartz sand ensures that a plasma that forms when the fusible conductor 5 melts is cooled down very rapidly.

The embodiment shown in FIG. 1, especially regarding the centrosymmetrical shape of the fusible conductor 5, is not limited to the "S" shape, but rather, can also contain several "standing waves" and "stationary nodes". Suitable shapes for the fusible conductor 5 are particularly all shapes that convert an expansion caused by thermo-mechanical stresses in the fusible conductor 5 into a resilient (rotational) movement of the fusible conductor 5.

Figure 2:
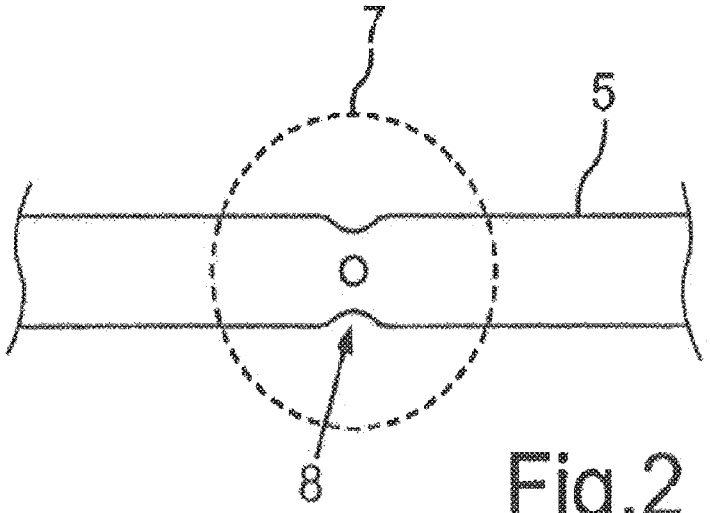
FIG. 2: a fusible conductor with a pseudo-fuse formed therein, according to an embodiment of the invention.

FIG. 2 shows an example of a fusible conductor 5 that has a pseudo-fuse 8. The pseudo-fuse 8 is preferably located in the area of the rotation point 7. This is especially advantageous because the mechanical loads on the fusible conductor 5 are minimal in the area of the rotation point 7 when the fusible conductor 5 is arranged in a point of symmetry of the fusible conductor 5—here the rotation point 7—in accordance with an embodiment of the invention given by way of an example. The pseudo-fuse 8 can ensure a fast response by the fusible conductor 5, whereby the remaining part of the fusible conductor 5 serves to dissipate heat that has been generated near or by the pseudo-fuse 8.

A melting fuse 10 having the above-mentioned features can greatly increase the service life and durability, in spite of thermo-mechanical loads.

The invention claimed is:

1. A melting fuse, especially for a motor vehicle that has a high-voltage circuit, said fuse comprising:
- an electrically insulating housing;
- a fusible conductor inside the housing;
- two contacts connected with each other by the fusible conductor,
- wherein, between two longitudinal areas that are adjacent to each other, the fusible conductor has a rotation point around which the longitudinal areas are rotatable during thermo-mechanical expansion,
- wherein the fusible conductor is bent uniformly and free of kinks so as to allow expansions of the fusible conductor caused by thermo-mechanical stresses to be converted into rotational movement,
- wherein the fusible conductor is surrounded in the insulating housing by an arc suppressing means, and
- wherein the fusible conductor is movable inside the arc suppressing means that surrounds it.

2. The melting fuse of claim 1, wherein the arc suppressing means is quartz sand.

3. The melting fuse of claim 1, wherein the fusible conductor to has a reduced cross-section at the rotation point.

4. The melting fuse of claim 1, wherein the fusible conductor has a centrosymmetrical shape having a centrosymmetrical point.

5. The melting fuse of claim 1, wherein the fusible conductor has a reduced cross-section at the centrosymmetrical point.

6. A melting fuse, especially for a motor vehicle that has a high-voltage circuit, said fuse comprising:
- an electrically insulating housing;
- a fusible conductor inside the housing;
- two contacts connected with each other by the fusible conductor, wherein, between two longitudinal areas that are adjacent to each other, the fusible conductor has a rotation point around which the longitudinal areas are rotatable during thermo-mechanical expansion,
- wherein the fusible conductor is bent uniformly and free of kinks so as to allow expansions of the fusible conductor caused by thermo-mechanical stresses to be converted into rotational movement, and
- wherein the fusible conductor has a centrosymmetrical shape having a centrosymmetrical point, the centrosymmetrical point of the centrosymmetrical shape being the rotation point.

7. The melting fuse of claim 6, wherein the fusible conductor has a reduced cross-section at the centrosymmetrical point.

8. The melting fuse of claim 6, wherein the fusible conductor is surrounded in the insulating housing by an arc suppressing means, and wherein the fusible conductor is movable inside the arc suppressing means that surrounds it.

9. The melting fuse of claim 8, wherein the arc suppressing means is quartz sand.

* * * * *